US009993854B2

(12) United States Patent
Macaulay et al.

(10) Patent No.: US 9,993,854 B2
(45) Date of Patent: Jun. 12, 2018

(54) APPARATUS AND METHOD FOR TREATING SUBSEA FLUID CONDUITS

(71) Applicant: Paradigm Flow Services Limited, Banchory (GB)

(72) Inventors: Angus Macaulay, Banchory (GB); Hugh Mackenzie, Banchory (GB)

(73) Assignee: PARADIGM FLOW SERVICES LIMITED, Banchory (GB)

( * ) Notice: Subject to any disclaimer, the term of this patent is extended or adjusted under 35 U.S.C. 154(b) by 0 days. days.

(21) Appl. No.: 15/302,135

(22) PCT Filed: Apr. 7, 2015

(86) PCT No.: PCT/GB2015/051058
§ 371 (c)(1),
(2) Date: Oct. 5, 2016

(87) PCT Pub. No.: WO2015/150837
PCT Pub. Date: Oct. 8, 2015

(65) Prior Publication Data

US 2017/0120309 A1 May 4, 2017

(30) Foreign Application Priority Data

Apr. 5, 2014 (GB) ..... 1406189.9

(51) Int. Cl.

| | |
|---|---|
| ***E21B 33/00*** | (2006.01) |
| ***E21B 41/00*** | (2006.01) |
| ***E21B 37/04*** | (2006.01) |
| ***E21B 44/06*** | (2006.01) |
| ***E21B 43/01*** | (2006.01) |
| ***E21B 17/01*** | (2006.01) |

(Continued)

(52) U.S. Cl.
CPC ..... *B08B 9/032* (2013.01); *E21B 41/0007* (2013.01)

(58) Field of Classification Search
None
See application file for complete search history.

(56) References Cited

U.S. PATENT DOCUMENTS 6,076,603 A * 6/2000 Perrin ..... E21B 37/02 166/170
8,281,862 B2 * 10/2012 Barber ..... E21B 41/0007 166/250.17

(Continued)

*Primary Examiner* — Matthew R Buck
*Assistant Examiner* — Douglas S Wood
(74) *Attorney, Agent, or Firm* — Perkins Coie LLP

(57) ABSTRACT

An apparatus and method for collecting fluid during flushing of a subsea fluid conduit such as a subsea umbilical. The apparatus comprises a vessel configured to receive fluid from the subsea fluid conduit, and a first connector for fluidly coupling the vessel to the subsea flowline. In one aspect, the apparatus comprises a second connector for fluidly coupling the apparatus to a subsea production system and a flow control system. The flow control system is configured to operate in a first mode in which flushing fluid is directed from the subsea fluid conduit into the vessel, and is configured to operate in a second mode of operation in which the fluid is diverted from the subsea flowline to the subsea production system. In another aspect, the apparatus is configured to provide a detectable signal to surface when a pre-determined volume of flushing fluid has been received in the vessel.

29 Claims, 4 Drawing Sheets

(51) Int. Cl.
*E21B 43/00* (2006.01)
*B08B 9/032* (2006.01)

(56) References Cited

U.S. PATENT DOCUMENTS 8,684,089 B2 * 4/2014 Borhaug ..... E21B 7/124
137/15.04
8,770,892 B2 * 7/2014 Sweeney ..... B08B 9/055
405/184.1
8,978,767 B2 * 3/2015 Machin ..... E21B 33/068
166/338
9,169,714 B2 * 10/2015 Edwards ..... E21B 41/0007

* cited by examiner

APPARATUS AND METHOD FOR TREATING SUBSEA FLUID CONDUITS

The present invention relates to an apparatus and method for treating subsea fluid conduits, and in particular to an apparatus and method for the flushing of subsea fluid conduits, such as subsea umbilicals, used in offshore hydrocarbon exploration and production systems. Particular aspects of the invention relate to an apparatus comprising a vessel configured receive fluid flushed through a subsea fluid conduit, such as a subsea umbilical flow line or a hydraulic control line, and a method of use.

BACKGROUND TO THE INVENTION

In the hydrocarbon exploration and production industries, it is common for offshore production systems to have arrangements of subsea infrastructure that include fluid conduits which connect various subsea manifolds to subsea wellheads, and connect subsea components to surface facilities. An example of a simple hydrocarbon production system is shown in FIG. 1, generally depicted at 10. The offshore production system 10 comprises a surface installation 12, which in this case is a floating production storage and offloading vessel (FPSO) connected to a subsea wellhead 14, via a production flowline 16, a production manifold 18, and a flexible riser 20.

The system 10 also comprises an injection flow system, which in this example is formed from a subsea umbilical 22, comprising dynamic umbilical portion 22*a* and static umbilical portion 22*b*, and a chemical injection line 24. In this example, the static umbilical portion 22*b* is coupled to a chemical injection unit 23, to which the chemical injection line 24 is joined. In addition, in this embodiment, the dynamic umbilical portion 22*a* is joined to the static umbilical portion 22*b* via umbilical termination 21. In alternative arrangements, the umbilical termination unit 21 may be omitted, and the dynamic and static portions of the umbilical 22 may be directly joined.

During production operations, the umbilical 22 may be used to inject chemicals into the wellbore via the wellhead, for example to stimulate production. This typically involves pumping chemicals via a pump on the surface installation 12 through one or more of several fluid bearing cores contained in the umbilical 22. The umbilical may also comprise hydraulic control lines used to control hydraulically actuated devices or subsystems such as a valves or components of manifolds, which form a part of the subsea infrastructure.

From time to time it becomes necessary to clean or flush out one or more cores of the umbilical 22 to prevent a risk of blockage or damage. For example, flushing may be required if contamination or degradation of the chemicals contained within a core is detected, or it may be necessary to flush one or more cores of the umbilical prior to injection of a different chemical.

It is an aim of the invention to provide an apparatus for and a method of flushing a subsea fluid conduit, such as an umbilical flow line or a hydraulic control line. It is a further aim of the invention to provide an apparatus for and method of flushing subsea fluid conduits, such as an umbilical flow line or a hydraulic control line, which is economical and convenient to deploy and operate.

Other aims and objections of the invention will become apparent from reading the following description.

SUMMARY OF THE INVENTION

According to a first aspect of the present invention, there is provided an apparatus for collecting fluid during flushing of a subsea fluid conduit, the apparatus comprising:

a vessel configured to receive fluid from a subsea fluid conduit to be flushed;

a first connector for fluidly coupling the vessel to the subsea fluid conduit;

a second connector for fluidly coupling the apparatus to a subsea production system; and a flow control system;

wherein the flow control system is configured to operate in a first mode in which flushing fluid is directed from the subsea fluid conduit into the vessel, and is configured to operate in a second mode of operation in which the fluid is diverted from the subsea flowline to the subsea production system.

Preferably the first connector is configured to couple the apparatus to a subsea umbilical.

In a preferred embodiment, the vessel comprises an expandable interior volume.

The apparatus may be configured to provide a detectable signal to surface when a pre-determined volume of flushing fluid has been received in the vessel.

Preferably, the subsea fluid conduit is a component of a subsea umbilical, which may be an umbilical flow line. Alternatively, or in addition, the subsea fluid conduit may be a hydraulic control line. Where the subsea fluid conduit is an umbilical flow line, it may be configured to be coupled to a subsea well which forms a part of the subsea production system. Where the subsea fluid conduit is a hydraulic control line, it may be configured to be coupled to a hydraulically actuated device or subsystem (such as a valve or a component of a manifold) which forms a part of the subsea production system.

Preferably, the vessel is formed from a material selected to be resistant to a fluid conveyed by the subsea fluid conduit.

The apparatus may comprise an actuator operable to switch the apparatus from the first mode to the second mode and/or vice versa. The actuator may be operable to be actuated by the vessel when in an expanded condition. The actuator may comprise a force sensitive actuator, which may be configured for actuation by a force from the vessel when in an expanded condition.

The apparatus may comprise a first diverter valve for diverting flow from a path between the fluid conduit and the vessel, to a path between the fluid conduit and the subsea production system.

The first diverter valve may be actuated by the actuator.

The apparatus may be configured to provide a detectable signal to surface on actuation of the first diverter valve. The detectable signal may be a pressure signal (for example a detectable change in back pressure), which may be transmitted through the fluid conduit to surface.

The apparatus may comprise a first flow valve, operable to be actuated by the actuation of the first diverter valve. The first flow valve may be configured to provide a detectable signal to surface. The first flow valve may be configured to cause an increase in back pressure in the fluid conduit, and may be a first isolation valve.

The apparatus may comprise a first pressure relief circuit configured to reset the first flow valve. The first pressure relief circuit may open the first flow valve to enable fluid to flow from the fluid conduit to the first diverter valve. The first pressure relief circuit may comprise a first pressure relief valve, which may be set to a first pressure relief threshold.

Preferably, resetting the first flow valve provides a detectable signal at surface, which may indicate that a flow path between the fluid conduit and the subsea production system is open.

The apparatus may comprise a secondary divert flow system for diverting flow from a path between the fluid conduit and the vessel, to a path between the fluid conduit and the subsea production system in the event that a first diverter valve is not actuated.

The apparatus may comprise a second diverter valve for diverting flow from a path between the fluid conduit and the vessel, to a path between the fluid conduit and the subsea production system. The second diverter valve may be configured for operation in the event that the first diverter valve is not actuated.

The second diverter valve may be actuated in response to an increased pressure in a flow path between the fluid conduit and the vessel. The apparatus may comprise a second flow valve, operable to be actuated by the actuation of the second diverter valve. The second flow valve may be configured to provide a detectable signal to surface. The second flow valve may be configured to cause an increase in back pressure in the fluid conduit, and may be a second isolation valve.

The apparatus may comprise a second pressure relief circuit configured to reset the second flow valve. The second pressure relief circuit may open the second flow valve to enable fluid to flow from the fluid conduit to the second diverter valve. The second pressure relief circuit may comprise a second pressure relief valve, which may be set to a second pressure relief threshold. The second pressure relief threshold is preferably higher than the first pressure relief threshold.

Preferably, resetting the second flow valve provides a detectable signal at surface, which may indicate that a flow path between the fluid conduit and the subsea production system is open.

By providing first and second pressure relief circuits, incorporating first and second pressure relief valves with different pressure relief thresholds, detectable signals may be provided to the surface which indicate whether the first diverter valve has been actuated, or whether the second diverter valve has been actuated.

According to a second aspect of the invention, there is provided an apparatus for collecting fluid during flushing of a subsea fluid conduit, the apparatus comprising:

a vessel configured to receive fluid from a subsea fluid conduit to be flushed;

a connector for fluidly coupling the vessel to the subsea fluid conduit;

wherein the apparatus is configured to provide a detectable signal to surface when a pre-determined volume of flushing fluid has been received in the vessel.

Preferably, the apparatus comprises a flow control system. The flow control system may be configured to operate in a first mode in which flushing fluid is directed from the subsea flowline into the vessel, and/or may be configured to operate in a second mode of operation in which the fluid is diverted from the subsea flowline to the subsea production system.

Preferably the first connector is configured to couple the apparatus to a subsea umbilical.

Preferably, the subsea fluid conduit is a component of a subsea umbilical, which may be an umbilical flow line. Alternatively, or in addition, the subsea fluid conduit may be a hydraulic control line.

In a preferred embodiment, the vessel comprises an expandable interior volume.

The apparatus may be configured to provide a detectable signal to surface when a pre-determined volume of flushing fluid has been received in the vessel.

Embodiments of the second aspect of the invention may include one or more features of the first aspect of the invention or its embodiments, or vice versa.

According to a third aspect of the invention, there is provided there is provided a subsea apparatus for use in a flushing operation, the apparatus comprising:

a vessel configured to receive fluid from a subsea fluid conduit to be flushed; and a connector for fluidly coupling the vessel to the subsea fluid conduit;

wherein the vessel comprises an expandable interior volume.

The vessel may comprise a flexible membrane, and may comprise a bladder. In an alternative embodiment, the vessel comprises a tank or container with an expandable interior volume. Embodiments of the invention may comprise a combination of a flexible membrane and a tank or container with an expandable interior volume.

Preferably, the apparatus comprises a flow control system. The flow control system may be configured to operate in a first mode in which flushing fluid is directed from the subsea fluid conduit into the vessel, and/or may be configured to operate in a second mode of operation in which the fluid is diverted from the subsea fluid conduit to the subsea production system.

The apparatus may be configured to provide a detectable signal to surface when a pre-determined volume of flushing fluid has been received in the vessel.

Preferably the first connector is configured to couple the apparatus to a subsea umbilical.

Preferably, the subsea fluid conduit is a component of a subsea umbilical, which may be an umbilical flow line. Alternatively, or in addition, the subsea fluid conduit may be a hydraulic control line.

Preferably, the vessel is formed from a material selected to be resistant to a fluid conveyed by the subsea fluid conduit.

Embodiments of the third aspect of the invention may include one or more features of the first or second aspects of the invention or their embodiments, or vice versa.

According to a fourth aspect of the invention, there is provided an offshore hydrocarbon production system comprising:

an apparatus according to the first to third aspects of the invention;

a subsea hydrocarbon production system; and a subsea fluid conduit;

wherein the connector fluidly couples the vessel to the subsea flowline to receive flushing fluid from the subsea fluid conduit.

Preferably, the subsea fluid conduit is a component of a subsea umbilical, which may be an umbilical flow line.

More preferably, the subsea fluid conduit is a multi-core umbilical. The multi-core umbilical may be part of a chemical injection system for a subsea well.

Where the subsea fluid conduit is an umbilical flow line, it may be configured to be coupled to a subsea well which forms a part of the subsea production system.

The system may comprise a subsea well. Preferably the apparatus is coupled to the subsea well.

Alternatively, or in addition, the subsea fluid conduit may be a hydraulic control line.

Where the subsea fluid conduit is a hydraulic control line, it may be configured to be coupled to a hydraulically actuated device or subsystem (for example, a valve or a component of a manifold) which forms a part of the subsea production system.

In a preferred embodiment, the vessel comprises an expandable interior volume. The vessel may comprise a flexible membrane, and may comprise a bladder. In an alternative embodiment, the vessel comprises a tank or container with an expandable interior volume.

The apparatus may comprise a frame configured to support the apparatus on the seabed.

Embodiments of the fourth aspect of the invention may include one or more features of the first to third aspects of the invention or their embodiments, or vice versa.

According to a fifth aspect of the invention, there is provided a method of flushing a subsea fluid conduit, the method comprising:

providing an apparatus in a subsea location, the apparatus having a vessel and a connector for fluidly coupling the vessel to the subsea fluid conduit;

receiving fluid flushed through the subsea fluid conduit in the vessel during the first mode of operation;

diverting fluid from the subsea fluid conduit to a subsea production system during a second mode of operation.

The method may comprise actuating a diverter valve of the apparatus to divert the flow of flushing fluid from a first flow path connected to an inlet to the vessel, to a second flow path connected to the subsea production system.

Where the subsea fluid conduit is an umbilical flow line, it may be configured to be coupled to a subsea well which forms a part of the subsea production system. Where the subsea fluid conduit is a hydraulic control line, it may be configured to be coupled to a hydraulically actuated device or subsystem (such as a valve or a component of a manifold) which forms a part of the subsea production system.

The method may comprise providing a detectable signal to surface when a volume of fluid received in the vessel exceeds a pre-determined volume.

The method may comprise actuating an actuator to switch the apparatus from the first mode to the second mode and/or vice versa using an actuator. The method may comprise actuating the actuator when the vessel is in an expanded condition. The method may comprise actuating the actuator by a force from the vessel when in an expanded condition.

The method may comprise operating a first diverter valve to divert flow from a path between the fluid conduit and the vessel, to a path between the fluid conduit and the subsea production system.

The method may comprise actuating the first diverter valve using the actuator.

The method may comprise providing a detectable signal to surface on actuation of the first diverter valve. The detectable signal may be a pressure signal (for example a detectable change in back pressure), and the method may comprise transmitted a pressure signal through the fluid conduit to surface.

The method may comprise actuating a first flow valve by the actuation of the first diverter valve. The method may comprise providing a detectable signal to surface from first flow valve. The first flow valve may be configured to cause an increase in back pressure in the fluid conduit, and may be a first isolation valve.

The method may comprise resetting the first flow valve, and may comprise opening the first flow valve to enable fluid to flow from the fluid conduit to the first diverter valve. The method may comprise opening a first pressure relief valve at a first pressure relief threshold.

Preferably, resetting the first flow valve provides a detectable signal at surface, which may indicate that a flow path between the fluid conduit and the subsea production system is open.

The method may comprise operating a second diverter valve to divert flow from a path between the fluid conduit and the vessel, to a path between the fluid conduit and the subsea production system. The method may comprise operating second diverter valve in the event that the first diverter valve is not actuated.

The method may comprise actuating the second diverter valve in response to an increased pressure in a flow path between the fluid conduit and the vessel. The method may comprise operating a second flow valve by actuation of the second diverter valve. The method may comprise providing a detectable signal to surface from the second flow valve. The second flow valve may be configured to cause an increase in back pressure in the fluid conduit, and may be a second isolation valve.

The method may comprise resetting the second flow valve, and may comprise opening the second flow valve to enable fluid to flow from the fluid conduit to the second diverter valve. The method may comprise opening a second pressure relief valve at a second pressure relief threshold. The second pressure relief threshold is preferably higher than the first pressure relief threshold.

Preferably, resetting the second flow valve provides a detectable signal at surface, which may indicate that a flow path between the fluid conduit and the subsea production system is open.

By providing first and second pressure relief circuits, incorporating first and second pressure relief valves with different pressure relief thresholds, detectable signals may be provided to the surface which indicate whether the first diverter valve has been actuated, or whether the second diverter valve has been actuated.

The method may comprise deploying the apparatus from surface to subsea location, and may comprise recovering the apparatus from the subsea location. Recovering the apparatus from the subsea location may take place at a time later—optionally significantly later—than switching diverting flow from a path between the fluid conduit and the vessel, to a path between the fluid conduit and the subsea production system. This enables recovery of the apparatus to take place at an operationally convenient time, with minimal disruption to the normal operation of the fluid conduit.

Embodiments of the fifth aspect of the invention may include one or more features of the first to fourth aspects of the invention or their embodiments, or vice versa.

According to a sixth aspect of the invention, there is provided a method of flushing a subsea fluid conduit, the method comprising:

providing an apparatus in a subsea location, the apparatus having a vessel and a connector for fluidly coupling the vessel to the subsea fluid conduit;

receiving fluid flushed through the subsea flowline in the vessel;

providing a detectable signal to surface when a volume of fluid received in the vessel exceeds a pre-determined volume.

The method may comprise receiving fluid flushed through the subsea fluid conduit in the vessel during the first mode of operation; and diverting fluid from the subsea fluid conduit to a subsea production system during a second mode of operation.

Embodiments of the sixth aspect of the invention may include one or more features of the first to fourth aspects of the invention or their embodiments, or vice versa.

According to a further aspect of the invention, there is provided an apparatus for use in a flushing operation substantially as described herein with reference to FIG. 2.

According to a further aspect of the invention, there is provided an apparatus for use in a flushing operation substantially as described herein with reference to FIG. 3.

According to a further aspect of the invention, there is provided a method of flushing a subsea flowline substantially as described herein with reference to the drawings.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

As described above, FIG. 1 is a schematic representation of a simplified conventional offshore hydrocarbon production system, in which a subsea umbilical 22 is used in a chemical injection application. The present invention provides apparatus and methods for flushing fluid conduits, such as those included in umbilicals 22, and will be described with reference to the system 10 of FIG. 1. It will be appreciated that the invention extends beyond application to the offshore system of FIG. 1, and in particular may be used for flushing of fluid conduits in other systems or items of subsea infrastructure. In addition, the invention has application to the flushing of hydraulic control lines, such as hydraulic controls contained in subsea umbilicals, which are used to control hydraulically actuated devices or subsystems such as valves or a components of a manifold which form a part of items of subsea infrastructure.

Figure 1:
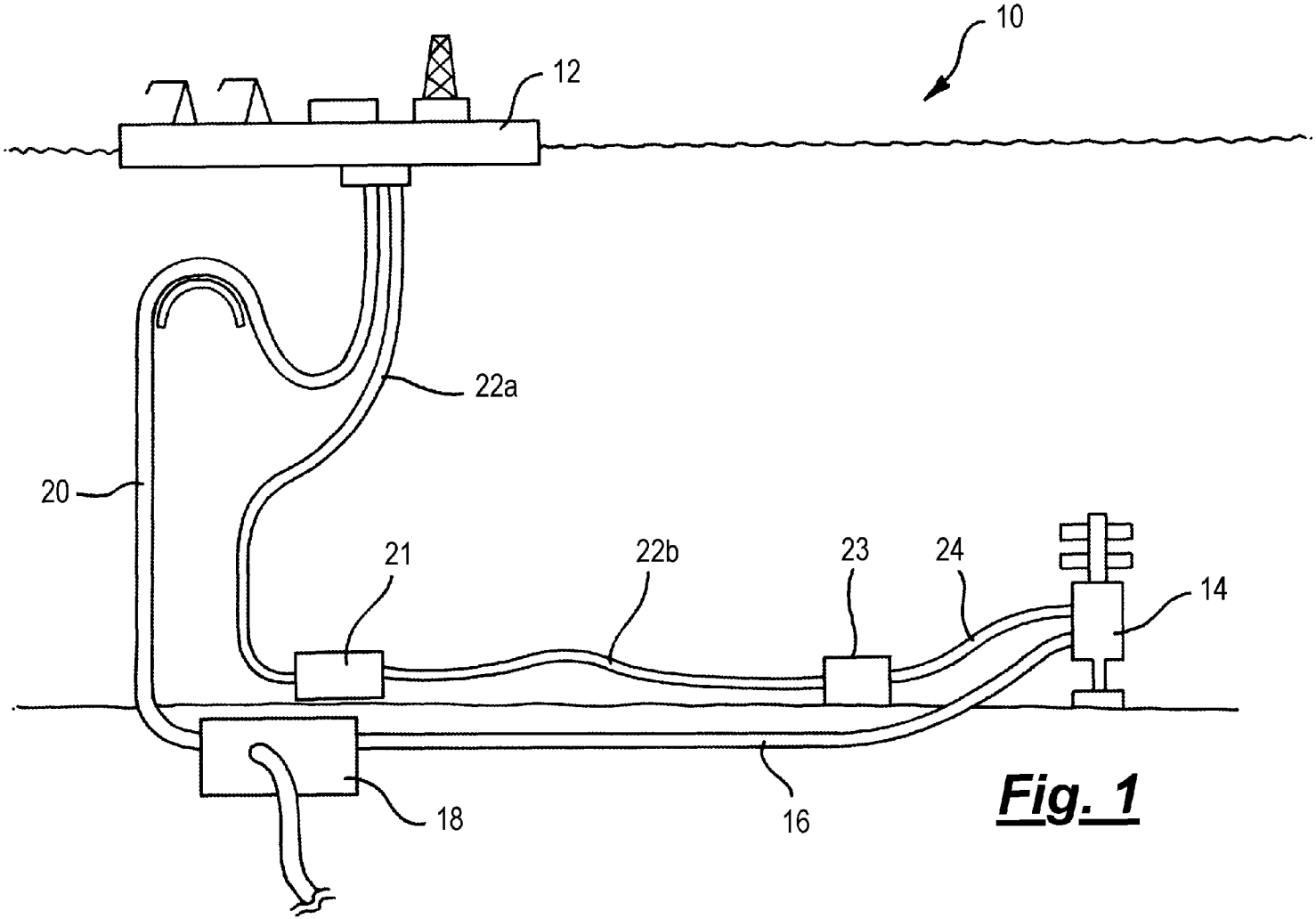
FIG. 1 is a schematic representation of an offshore hydrocarbon production system.
Figure 2:
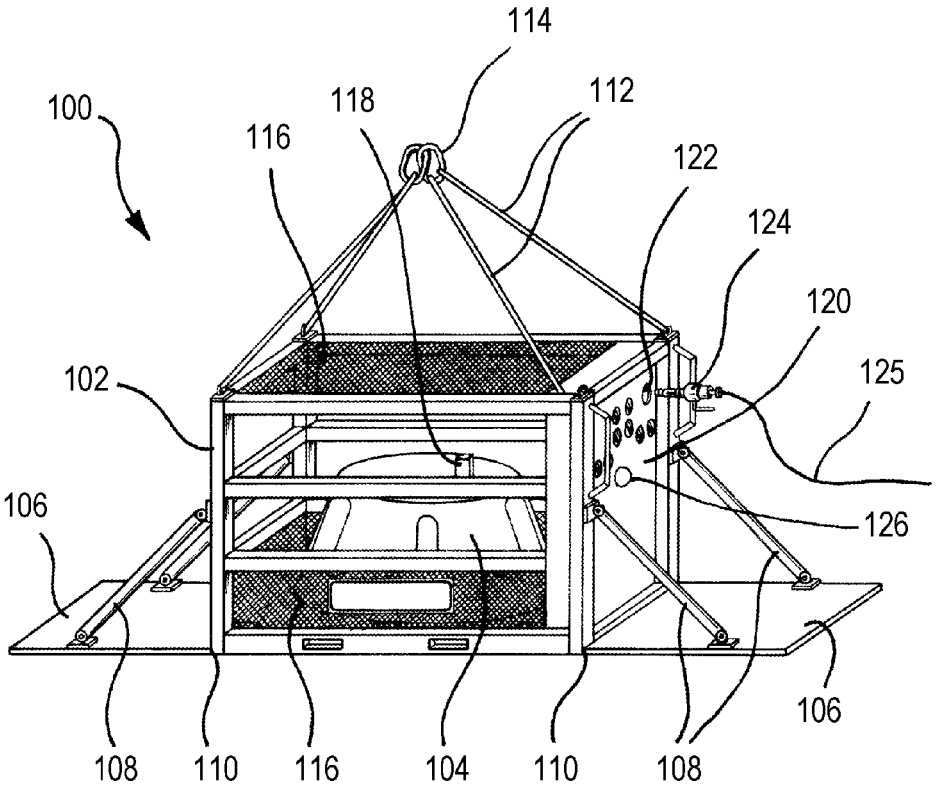
FIG. 2 is an isometric view of an apparatus according an embodiment of the invention.
Figure 3:
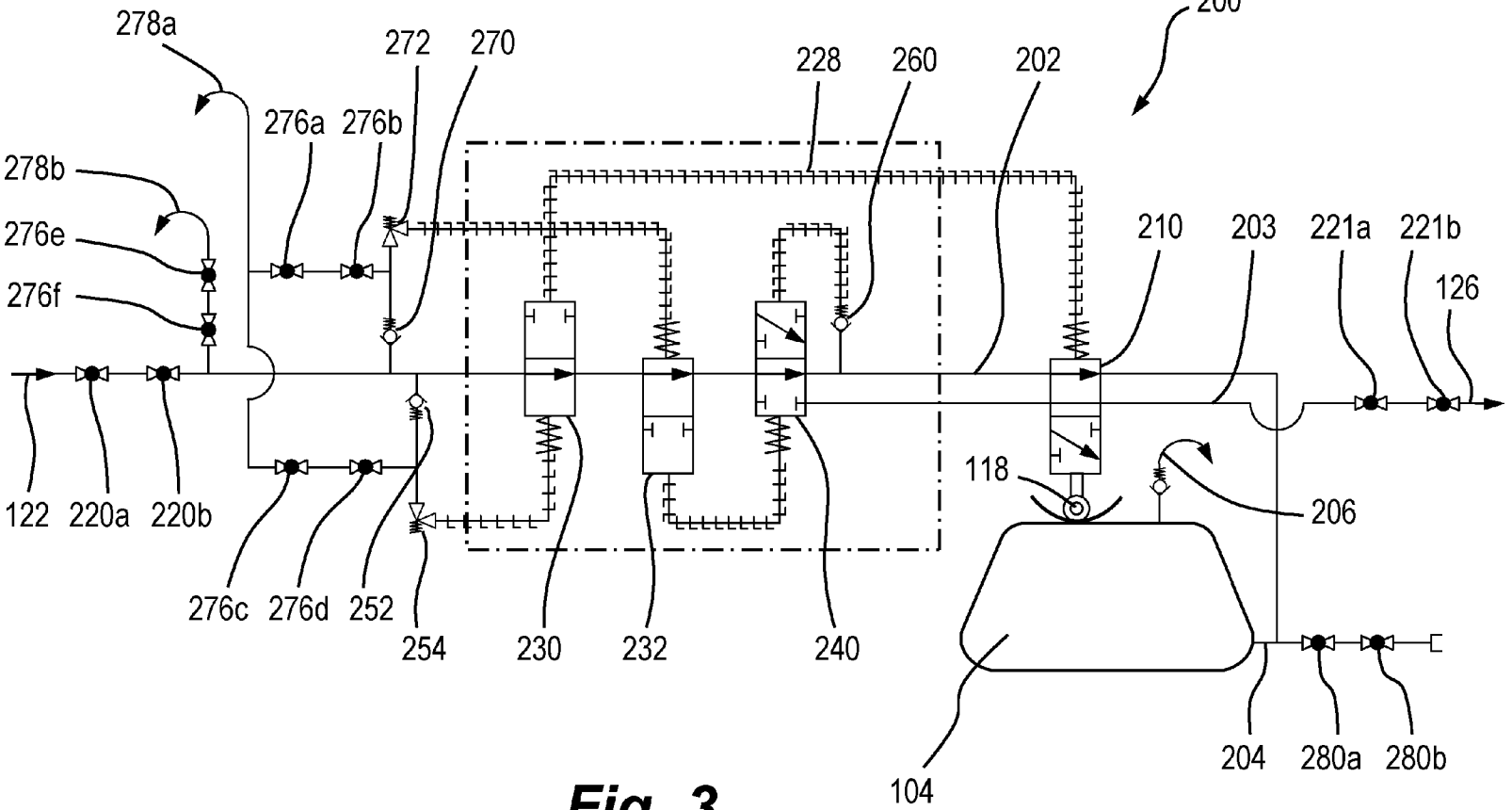
FIG. 3 is a piping and instrumentation diagram for a flow control system of an apparatus according to an embodiment of the invention.

FIG. 2 is an isometric view of an apparatus 100 according to an embodiment of the invention, and FIG. 3 is a piping and instrumentation diagram showing the apparatus and its flow control system 200 when installed in a hydrocarbon production system such as that shown in FIG. 1.

As shown in FIG. 2, the apparatus 100 comprises a frame 102, which provides support and protection for a vessel 104. In this embodiment, the vessel 104 is an expandable bladder formed from a flexible membrane, which has an internal volume that increases as fluid is received into the vessel. An upper surface of the vessel 104 comprises a force sensitive actuator 118, the operation of which will be described below. The vessel 104 is formed from materials which are resistant to the fluids conveyed by the subsea fluid conduits.

The apparatus 100 comprises additional support surfaces 106 which extend outwardly from the main frame to increase the area of the lower surface of the apparatus. Struts 108 support the support surfaces 106 in a plane with the lower surface of the main frame. In this embodiment, the support surfaces are hinged at their interface 110 with the main frame 102, and when the apparatus is lowered or raised to the seabed, the support surfaces 106 are folded upwards to reduce the footprint of the apparatus and provide additional protection to its outer surfaces.

The upper surface of the main frame 102 is provided with slings 112, which provide a coupling point 114 for a cable or chain (not shown) to enable deployment or recovery of the apparatus from surface (for example, from a supply vessel). Mesh plates 116 on the upper surface and lower parts of the side surfaces provide the apparatus with additional protection, and provide a containing volume for the vessel in an expanded condition.

A side panel of the apparatus 100 is provided with a plate 120 comprising number of ports for the connection of fluid lines. In this example, the plate 120 comprises a number of receptacles for hot stab connectors, such as an inlet stab receptacle 122 which is configured to receive a hot stab connector 124 which is coupled to a single core 125 of the umbilical 22.

Internal flow paths (not shown) of the receptacle 122 are configured to direct the core 125 to the interior volume of the bladder via the flow control system 200. The plate 120 also comprises an outlet hot stab receptacle 126 which is configured to receive a stab connector for a single core jumper flowline which connects the apparatus into a subsea production system. In this example the jumper flowline couples the output stab receptacle 126 of the apparatus to an input stab receptacle on the chemical injection unit, to which the core 125 would be fluidly coupled in normal use.

In the example above, a single core of the umbilical is connected to the apparatus with remaining cores of the umbilical remaining connected to the production system. This may be possible when a diver has access to the umbilical and can isolate the core that needs to be flushed (for example in shallow water).

In an alternative embodiment, the apparatus may be provided with a multi-core stab plate receptacle panel that is designed to receive a multi-core stab plate from the umbilical 22. In this configuration, multiple cores of the umbilical are tied into a single stab plate to enable the multiple cores of the umbilical to be coupled to the apparatus. Internal flow paths (not shown) of the apparatus are configured to direct at least one of the cores of the umbilical 22 to the interior volume of the bladder via the flow control system 200. Other cores of the umbilical, which do not need to be flushed, are routed to a multi-core outlet stab plate receptacle, and are connected back to the production system by a multi-core jumper flowline. A stab plate connection of this type may be particularly suitable for ROV-based manipulation and operation (for example in deepwater).

Other connection methods or combinations thereof may be used within the scope of the invention, including but not limited to threaded JIC fittings and JIC plates.

The flow control system 200 will now be described with reference to FIG. 3. The flow control system comprises a main flowline 202 which passes from the inlet stab receptacle 122 to an inlet 204 to the vessel 104 in a first mode of use, and from the inlet stab receptacle 122 to the outlet stab receptacle 126 in a second mode of use.

As noted above, the bladder 104 comprises a force sensitive actuator 118. This actuator 118 is connected to a first diverter valve 210, which is operable to be actuated by the actuator when a mechanical force is experienced due to the expansion of the bladder 104 as fluid is received from the umbilical 22. The actuator 118 is set to actuate the first diverter valve when the bladder has received a predetermined volume of fluid from the umbilical 22, sufficient to flush the umbilical. The primary function of the first diverter valve is to divert flow from the inlet 204 to the bladder to the flowline of the outlet stab receptacle 126. The bladder 104 is also provided with a safety non-return valve 206, which provides a vent path to the subsea environment in the event that the bladder 104 is significantly over pressured.

The flowline 202 from the umbilical core to the first diverter valve 210 also comprises first and second isolation ball valves 220*a*, 220*b*, which function to isolate the flow control system from the umbilical core, first and second isolation valves 230, 232, and second diverter valve 240. The default position of the first and second isolation valves 230, 232 and the second diverter valve 240 in a flushing mode of operation is open, providing a flowline from the umbilical to the inlet 204 of the bladder 104. First and second outlet isolation ball valves 221*a*, 221*b* are provided immediately upstream of the outlet stab receptacle 126.

As noted above, this embodiment of the invention is described in the context of flushing a subsea umbilical. In use, the apparatus 100 is preconfigured to provide a flow path from the selected umbilical core or cores to be flushed via the stab connector 124 and into the flow control system 200. The apparatus 100 is brought to the required offshore location by a supply vessel, from which it is deployed by means of a winch and cable paid out from the surface of the supply vessel. Depending on the water depth, the deployment of the apparatus may be assisted by a remotely operated vehicle (ROV) or one or more divers. The apparatus 100 is landed on the seabed at a location close to the chemical injection unit 23, and the supported surfaces are arranged so that the apparatus is secure on the seabed. The apparatus is detached from the cable, which is recovered into surface and the vessel may optionally be mobilised to a remote location.

Isolation ball valves 220*a*, 220*b*, 221*a*, 221*b* are initially closed. The downstream end of the static portion of the umbilical 22*b* is disconnected from the chemical injection unit by removing the stab connector 124, and connecting the stab connector to the inlet stab receptacle 122. The outlet stab receptacle 126 is connected to the inlet to the chemical injection unit via a jumper flowline (not shown).

Figure 4A:
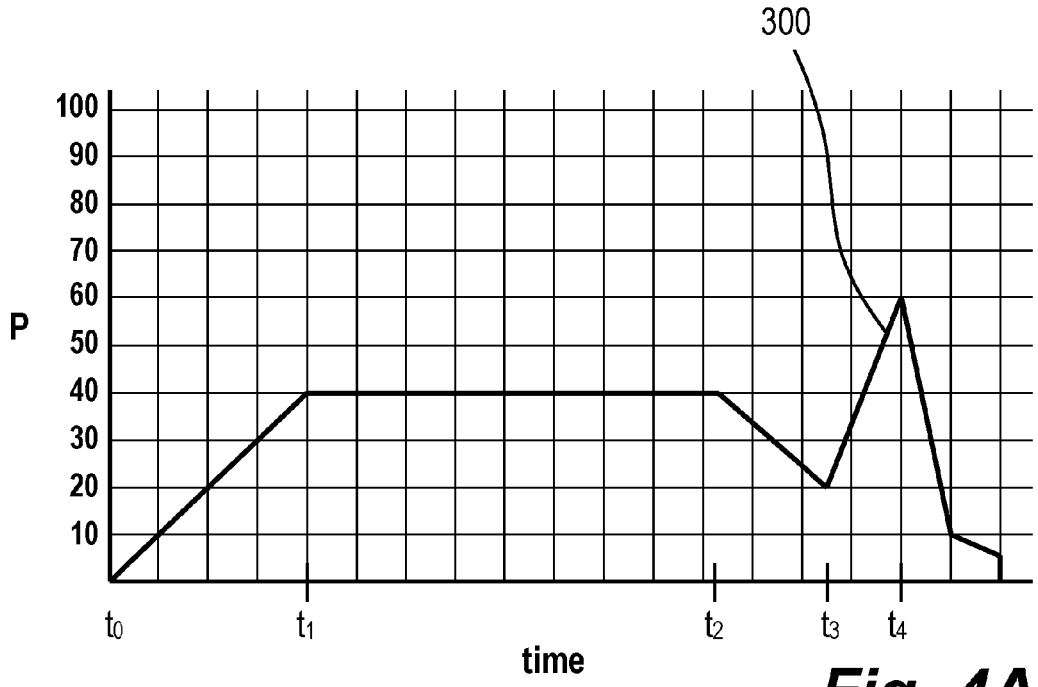
FIG. 4A is a graph schematically showing a pressure indication reading obtained during use of the apparatus in a normal mode of operation.
Figure 4B:
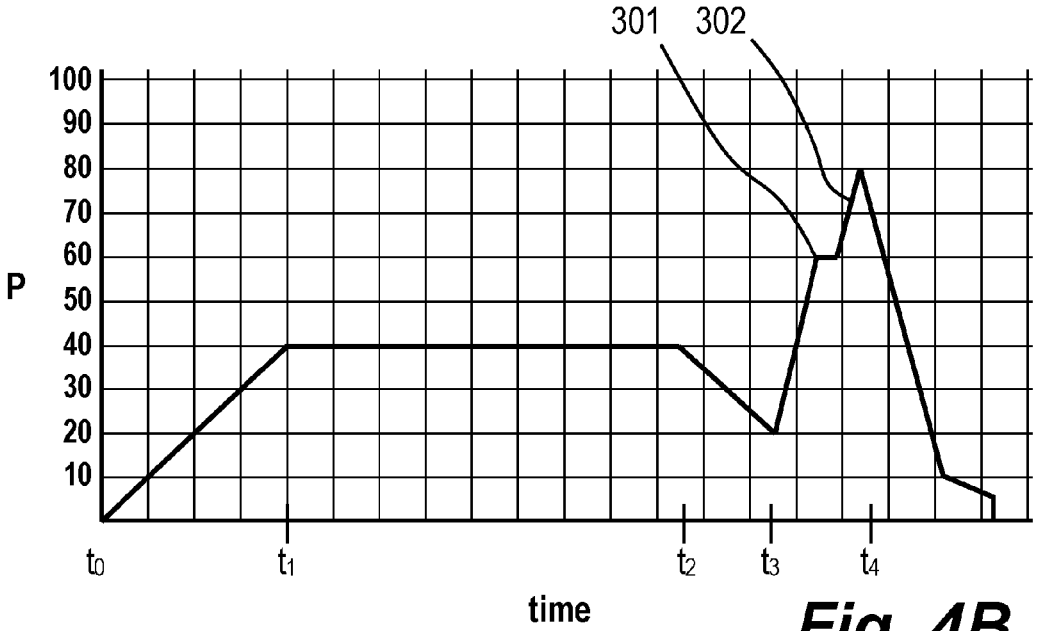
FIG. 4B is a graph schematically showing a pressure indication reading obtained during use of the apparatus while in a second mode of operation.

Isolation ball valves 220*a*, 220*b*, 221*a*, 221*b* are opened, and the flushing operation commences by pumping a flushing fluid from surface down the umbilical using a surface pump. An operator at surface monitors the hydraulic pressure on the outlet side of the pump. FIGS. 4A and 4B schematically show pressure indication readings obtained during use of the apparatus; FIG. 4A plots pressure against time during a flushing mode of operation.

In the period $t_0$ to $t_1$ pumping commences and pumping pressure builds up to the flushing pressure, which in this case is 40 bar (4000 kPa). Pumping continues at this pressure until $t_2$, at which time the operators have calculated that the volume of pumped fluid is approaching the required flushing volume. Pumping rate is automatically or manually reduced to provide additional control over the operation of the system, shown on FIG. 4A as a reduction in pump pressure in the period $t_2$ to $t_3$.

When the bladder 104 has received a pre-determined volume of fluid from the umbilical core, the bladder has inflated to a physical size sufficient to contact the actuator 118. The first diverter valve 220 is actuated to move to its second position, in which the flowline 202 is diverted from the inlet 204 to the bladder 104 to the outlet stab receptacle 126. This event occurs at time $t_3$ on FIG. 4A.

The diverter valve 220 is connected by a hydraulic signal line 228 to isolation valve 230. When diverter valve 220 is actuated, a signal is sent to the isolation valve 230, which in turn shuts off the flow from the umbilical core. With the flow from the umbilical core isolated, a pressure increase is detected at surface on the chart recorder. This is shown as a spike 300 in the pressure indication at surface, shown in FIG. 4A between time $t_3$ and $t_4$, as the pressure builds up on the upstream side of the isolation valve 230. As the pressure builds up, fluid flows through non-return valve 252 and builds up on pressure release valve 254 until a pre-determined pressure is reached. In the example depicted, the set pressure for the pressure release valve 254 is 60 bar (6000 kPa), which is reached at time $t_4$. When the pressure relief valve 254 is opened, a hydraulic signal is sent to isolation valve 230 to reopen the valve and allow fluid to flow from the umbilical core downstream to the first diverter valve 220. This causes the measured pressure to reduce subsequent to time $t_4$.

The detectable pressure spike at times $t_3$ to $t_4$ is a positive indication to an operator at surface that the bladder 104 has been filled, the umbilical core has been flushed, and that flow has recommenced from the flowline to the chemical injection unit 30.

The system also includes a failsafe mechanism, which provides a contingency in the event of an over-pressurisation of the system, or a failure in the operation of the first diverter valve 220. In such a situation, pressure will build up in the flowline immediately upstream of the bladder 104 as the bladder reaches its capacity. Pressure builds until it is sufficient to open the safety non-return valve 260, which results in a hydraulic signal to actuate the second diverter valve 240. The second diverter valve 240 functions to divert flow from the umbilical core away from the inlet 204 to the bladder 104 to the outlet stab receptacle of 126. Actuation of the second diverter valve sends a hydraulic signal to isolation valve 232, which closes off the flow from the umbilical core. Shut-off of the flow from the umbilical core is again seen as an increase in pressure at surface, as pressure builds up in the system. This event is shown at $t_3$ in FIG. 4B.

Fluid flows through the non-return valve 252, until the set pressure of the pressure release valve 254 (60 bar or 6000 kPa) is exceeded. Valve 230 is already open, and the pressure seen at surface levels off for a short time, as shown at 301, as the pressure in the system equalises. This indicates to an operator at surface that the diverter valve 210 has not opened as would be expected in normal operation.

Fluid flows through the non-return valve 270, until a set pressure of the pressure release valve 272 is exceeded. In this case, the pressure release valve 272 is set to 80 bar (8000 kPa), at which point an hydraulic signal is sent to isolation valve 232, to reopen the flow from the umbilical core to the second diverter valve 240. The set pressure of pressure return valve 272 is greater than that of pressure return valve 254, and therefore the detectable pressure spike 302 that occurs due to the triggering of the second diverter valve 240 is distinguishable from the pressure spike 300 which is visible due to the actuation of the first diverter valve 210. The pressure spike at 302 therefore indicates that the second diverter valve 240 as been actuated, and that the flow from the umbilical bore has been diverted away from the vessel to the production system.

With the flow path open to the chemical injection unit, chemical injection (for example for the stimulation of production) can recommence. The apparatus is ready for collection, which can take place at a later time.

The system 200 also comprises bleed down valves 276*a* to 276*f* and vents 278*a*, 278*b* which enable the pressure build up in the system to be vented to the surrounding sea water before disconnection of the system. When the apparatus is ready to be disconnected, isolation ball valves 220*a*, 220*b*, 221*a*, 221*b* are closed and the stab connector 124 of the umbilical is removed and replaced in the chemical injection unit.

The system 200 is also provided with drain down valves 280*a*, 280*b* which facilitate draining of the vessel 104 after recovery.

The described system delivers the following functionality. Firstly, the bladder provides a means for collecting chemicals flushed through the umbilical and through the flow system in a subsea location, and therefore provides a convenient means for remediation of an issue with the subsea flowline.

Secondly, the flow control system 200 provides automatic diversion of fluid from the umbilical core to the chemical injection unit at the production well. Therefore, after the umbilical has been flushed, the system reverts to the intended functionality of the umbilical, namely to facilitate fluid injection from surface to the production well. This provides the benefit that desired operation of the subsea umbilical is recommenced as soon as practicable, without further subsea intervention.

In particular, the bladder 104 may be sealed and left ready for collection on the seabed, but continued operations are not dependent on the availability of divers, ROV or a support vessel to intervene with the subsea equipment and/or collect the apparatus. Indeed, the apparatus can be recovered to surface at a convenient later time, such as when a support vessel and/or an ROV or diver team is in the vicinity to perform the recovery operation.

In addition, the apparatus provides redundancy in that a fail-safe system is provided which accounts for the possible failure of the first diverter valve.

Furthermore, the flow control system in the described configurations, communicates to surface when the bladder has received the required volume of flushing fluid. In the described example, this information is communicated to surface hydraulically by recording or monitoring a pressure signal at surface. Information received by the surface can be used by the operator to trigger scheduling of recovery of the apparatus by a support vessel. The system as described with reference to FIGS. 2 and 3, also allows an operator to distinguish a situation in which the apparatus is diverted to a production mode in normal operation, from a situation in which the fail-safe diversion mode has been actuated.

Although the system describes with reference to FIGS. 2 and 3 provides a signal to surface and diversion back to a chemical injection mode, it will be appreciated that in an alternative embodiment of the invention, diversion to production mode may be carried out manually, for example by intervention by an ROV or a team of divers.

Similarly, in an alternative embodiment of the invention, the flow control system provides a diversion of the fluid from the umbilical to a production mode when a sufficient volume of fluid has been flushed through the umbilical, but does not provide a signal to surface to indicate that the bladder has received the respective volume. In this configuration, reversion to a production mode may be based on the calculation of a fluid volume prompt at surface.

In alternative embodiments of the invention, other means for providing a signal to surface may be used. For example, when a pre-determined volume of fluid has been received into the bladder, a force sensitive switch or other actuator may be used to trigger a visible signal to a diver or an ROV to indicate that a production mode can be recommenced, and/or that the apparatus can be prepared for retrieval. Alternatively, or in addition, a force sensitive switch or other actuation mechanism may be used to release a buoyant indicator to surface, which may be detected visually.

The above-described detection means can also be combined with an electronic, electromagnetic or acoustic signal, which is transmitted from the apparatus or from a buoyant indicator released to surface, to indicate to an operator that the required volume has been received, and/or that the apparatus can be prepared for collection. It should be noted however that the hydraulic pressure monitoring technique described with respect to FIGS. 2 to 4 represents a preferred embodiment of the invention.

In further alternative configurations not shown in the drawings, multiple apparatus may be used in series, where the required flushing volume exceeds the capacity of a vessel in an individual apparatus.

In another variation, and as noted above, rather than using individual cores connected into the apparatus from an umbilical manifold, an umbilical stab plate and stab connector may be used, with internal flowline routing diverting the appropriate cause to the flow control system and apparatus.

The invention provides an apparatus and method for collecting fluid during flushing of a subsea fluid conduit such as a subsea umbilical. The apparatus comprises a vessel configured to receive fluid from the subsea fluid conduit, and a first connector for fluidly coupling the vessel to the subsea flowline. In one aspect, the apparatus comprises a second connector for fluidly coupling the apparatus to a subsea production system and a flow control system. The flow control system is configured to operate in a first mode in which flushing fluid is directed from the subsea fluid conduit into the vessel, and is configured to operate in a second mode of operation in which the fluid is diverted from the subsea flowline to the subsea production system. The apparatus may therefore be disposed between the subsea fluid conduit and the subsea production system, so that it is downstream of the subsea fluid conduit and upstream of the subsea production system. In the second mode of operation, the flow control system may be configured to bypass the vessel, such that flow of fluid from the interior of the subsea fluid conduit being flushed is directed to the subsea production system. In another aspect, the apparatus is configured to provide a detectable signal to surface when a pre-determined volume of flushing fluid has been received in the vessel.

Various modifications to the above-described embodiments may be made within the scope of the invention, and the invention extends to combinations of features other than those expressly claimed herein.

The invention claimed is:

1. An apparatus for collecting fluid during flushing of a subsea fluid conduit of a subsea umbilical, the apparatus comprising:

a vessel configured to receive fluid from the subsea fluid conduit of the subsea umbilical to be flushed;

a first connector for fluidly coupling the vessel to the subsea fluid conduit;

a second connector for fluidly coupling the apparatus to a subsea production system; and a flow control system;

wherein the flow control system is configured to operate in a first mode in which flushing fluid is directed from the subsea fluid conduit into the vessel, and is configured to operate in a second mode of operation in which the vessel is bypassed and flow of fluid from the subsea fluid conduit is directed to the subsea production system.

2. The apparatus according to claim 1, wherein the vessel comprises an expandable interior volume.

3. The apparatus according to claim 1, comprising an actuator operable to switch the apparatus from the first mode to the second mode and/or vice versa.

4. The apparatus according to claim 3, wherein the actuator is operable to be actuated by the vessel when in an expanded condition.

5. The apparatus according to claim 3, wherein the actuator comprises a force sensitive actuator, configured for actuation by a force from the vessel when in an expanded condition.

6. The apparatus according to claim 1, comprising a first diverter valve for diverting flow from a path between the subsea fluid conduit and the vessel, to a path between the subsea fluid conduit and the subsea production system.

7. The apparatus according to claim 1, configured to provide a detectable signal to surface when a pre-determined volume of flushing fluid has been received in the vessel.

8. The apparatus according to claim 7, wherein the detectable signal comprises a pressure signal transmitted through the subsea fluid conduit to surface.

9. The apparatus according to claim 1, comprising a first flow valve, operable to be actuated by the actuation of a first diverter valve wherein the first flow valve is configured to cause an increase in back pressure in the subsea fluid conduit.

10. The apparatus claim 9, comprising a first pressure relief circuit configured to reset the first flow valve.

11. The apparatus according to claim 1, comprising a secondary divert flow system for diverting flow from a path between the subsea fluid conduit and the vessel, to a path between the subsea fluid conduit and the subsea production system in the event that a first diverter valve is not actuated.

12. The apparatus according to claim 11, wherein the secondary divert flow system comprises a second diverter valve, which is configured to be actuated in response to an increased pressure in a flow path between the subsea fluid conduit and the vessel.

13. The apparatus according to claim 12, comprising a second flow valve, operable to be actuated by the actuation of the second diverter valve, wherein the second flow valve is configured to cause an increase in back pressure in the subsea fluid conduit.

14. The apparatus according to claim 13, comprising a second pressure relief circuit configured to reset the second flow valve.

15. The apparatus according to claim 14, wherein a first pressure relief circuit comprises a first pressure relief valve set to a first pressure relief threshold, and a second pressure relief circuit comprises a second pressure relief valve set to a second pressure relief threshold, wherein the second pressure relief threshold is higher than the first pressure relief threshold.

16. An offshore hydrocarbon production system comprising:

an apparatus according to claim 1;

a subsea hydrocarbon production system; and a subsea fluid conduit of a subsea umbilical;

wherein the connector fluidly couples the vessel to the subsea fluid conduit to receive flushing fluid from the subsea fluid conduit.

17. The system according to claim 16, wherein the subsea fluid conduit is a subsea umbilical flow line or a hydraulic control line of the subsea umbilical.

18. The system according to claim 16, wherein the subsea umbilical is a part of a chemical injection system for the subsea production system.

19. A method of flushing a subsea fluid conduit of a subsea umbilical, the method comprising:

providing an apparatus in a subsea location between the subsea fluid conduit of the subsea umbilical and a subsea production system, the apparatus having a vessel and a connector for fluidly coupling the vessel to the subsea fluid conduit;

receiving fluid flushed through the subsea fluid conduit in the vessel during a first mode of operation of a flow control system of the apparatus; and operating the flow control system of the apparatus such that in a second mode of operation, the vessel is bypassed such that flow of fluid from the subsea fluid conduit is directed to the subsea production system.

20. The method according to claim 19, comprising actuating an actuator to switch the apparatus from the first mode to the second mode and/or vice versa by a force from the vessel when in an expanded condition.

21. The method according to claim 19, comprising providing a detectable signal to surface when a volume of fluid received in the vessel exceeds a pre-determined volume.

22. The method according to claim 21, wherein the detectable signal is a pressure signal transmitted through the subsea fluid conduit to surface.

23. The method according to claim 19, comprising actuating a first flow valve by the actuation of a first diverter valve, and providing a detectable signal to surface from the first flow valve.

24. The method according to claim 23, comprising actuating the first flow valve to cause an increase in back pressure in the fluid conduit.

25. The method according to claim 23, comprising resetting the first flow valve to enable fluid to flow from the fluid conduit to the first diverter valve, and wherein resetting the first flow valve provides a detectable signal at surface.

26. The method according to claim 19, comprising operating a second diverter valve to divert flow from a path between the subsea fluid conduit and the vessel, to a path between the fluid conduit and the subsea production system, and operating a second flow valve by actuation of the second diverter valve, wherein the second flow valve is configured to cause an increase in back pressure in the subsea fluid conduit.

27. The method according to claim 19, comprising opening the first pressure relief valve at a first pressure relief threshold, and opening a second pressure relief valve at a second pressure relief threshold, wherein the second pressure relief threshold higher than the first pressure relief threshold.

28. The method according to claim 19, comprising recovering the apparatus from the subsea location at a time later than switching diverting flow from a path between the subsea fluid conduit and the vessel, to a path between the subsea fluid conduit and the subsea production system.

29. The method according to claim 19, further comprising:

operating a first diverter valve to divert flow from a path between the subsea fluid conduit and the vessel, to a path between the subsea fluid conduit and the subsea production system.

* * * * *